US005996314A

United States Patent [19]

Pennini et al.

[11] Patent Number: 5,996,314

[45] Date of Patent: Dec. 7, 1999

[54] CURRENCY STRAPPING MACHINE

[75] Inventors: Irving George Pennini, Plano; Anthony G. Orchard, Dallas; Charles L. Bradford, Garland; Mark A. Carrion, Plano, all of Tex.

[73] Assignee: Currency Systems International, Inc., Irving, Tex.

[21] Appl. No.: 08/651,726

[22] Filed: May 22, 1996

[51] Int. Cl.[6] ..... B65B 13/08

[52] U.S. Cl. ..... 53/399; 53/447; 53/540; 53/587; 53/589; 100/25; 100/33 PB; 270/58.08

[58] Field of Search ..... 100/7, 25, 26, 100/33 PB; 53/399, 447, 540, 542, 587, 589, 582, 588; 270/58.08, 58.09, 58.11, 58.12, 58.13

[56] References Cited

U.S. PATENT DOCUMENTS

| | | | |
|---|---|---|---|
| 2,612,737 | 10/1952 | Thielens | 53/399 |
| 3,955,340 | 5/1976 | Tomita et al. | 53/587 |
| 3,994,118 | 11/1976 | Felix | 53/587 X |
| 4,020,616 | 5/1977 | Nakajima et al. | 53/587 X |
| 4,020,972 | 5/1977 | Lundblad . | |
| 4,034,976 | 7/1977 | Lundblad . | |
| 4,066,253 | 1/1978 | Lundbald et al. . | |
| 4,128,236 | 12/1978 | Lundblad . | |
| 4,155,213 | 5/1979 | Blanton et al. | 53/587 |
| 4,252,251 | 2/1981 | Ek et al. . | |
| 4,343,582 | 8/1982 | Lundblad et al. . | |
| 4,374,463 | 2/1983 | Omuva et al. | 53/589 X |
| 4,376,364 | 3/1983 | Horino et al. | 53/587 X |
| 4,406,728 | 9/1983 | Ohba et al. . | |
| 4,407,107 | 10/1983 | Smith, Jr. . | |
| 4,424,660 | 1/1984 | Sato et al. | 53/588 X |
| 4,427,192 | 1/1984 | Kushmaul et al. . | |
| 4,447,097 | 5/1984 | Lafevers et al. . | |
| 4,459,052 | 7/1984 | Lundblad . | |
| 4,483,124 | 11/1984 | Ohba et al. | 53/587 X |
| 4,494,743 | 1/1985 | Kushmaul et al. . | |
| 4,501,416 | 2/1985 | Hain . | |
| 4,516,899 | 5/1985 | Wood et al. . | |
| 4,531,343 | 7/1985 | Wood . | |
| 4,539,789 | 9/1985 | Miyano et al. | 53/588 X |
| 4,540,614 | 9/1985 | Omori . | |
| 4,560,155 | 12/1985 | Hosking et al. . | |
| 4,578,932 | 4/1986 | Cooke | 53/587 |
| 4,593,895 | 6/1986 | Myers et al. . | |
| 4,603,847 | 8/1986 | Oota et al. . | |
| 4,610,124 | 9/1986 | Watanabe et al. . | |
| 4,627,218 | 12/1986 | Akerstrom et al. . | |
| 4,627,219 | 12/1986 | Omori . | |
| 4,661,185 | 4/1987 | Kobiella . | |
| 4,685,993 | 8/1987 | Flaherty et al. . | |

(List continued on next page.)

*Primary Examiner*—Daniel B. Moon
*Attorney, Agent, or Firm*—Gregory M. Howison; Mark W. Handley

[57] ABSTRACT

A method and apparatus automatically process currency documents. A stack of loose bank documents are placed on a feeder having a feeder arm which pushes the documents toward a continuous vacuum belt. The feeder arm is controlled by a lever arm connected to a potentiometer. The vacuum belt pulls documents from the stack, and moves the documents past a vacuum separator head and to a transport conveyor. The vacuum belt and the vacuum separator head are connected to the same vacuum supply. The transport conveyor moves the documents through inspection and sorting stations, and to various stacking units which stack the documents on platens. A strapping tape is curved to bend in a direction transverse to its length, and then a terminal end portion of the strapping tape is pushed through connected channels to direct the terminal end portion around three sides of a stack of the documents. A retaining arm clamps the terminal end portion of the strapping tape and the documents against the platen, and then the platen is rotated approximately 90 degrees to dispose an inward length of the strapping tape around a fourth side of the documents and alongside the terminal end portion of the strapping tape, looping the strapping tape completely around the stack of documents. A weld head extends, presses against the strapping tape and the documents, and fuses together the inward length and terminal end portion of the strapping tape. The document bundle is then dropped into a discharge bin.

28 Claims, 12 Drawing Sheets

U.S. PATENT DOCUMENTS

| | | | |
|---|---|---|---|
| 4,717,144 | 1/1988 | Rosengren . | |
| 4,736,852 | 4/1988 | Edin et al. . | |
| 4,759,447 | 7/1988 | Lundblad et al. . | |
| 4,760,923 | 8/1988 | Lundblad et al. . | |
| 4,793,251 | 12/1988 | Kuhfuss . | |
| 4,813,658 | 3/1989 | Hosking et al. . | |
| 4,816,652 | 3/1989 | Wildgoose et al. . | |
| 4,817,804 | 4/1989 | Kawano et al. | 53/588 X |
| 4,850,179 | 7/1989 | Takami . | |
| 4,860,133 | 8/1989 | Baranski . | |
| 4,890,766 | 1/1990 | Martin et al. . | |
| 4,910,944 | 3/1990 | Segalowitz et al. . | |
| 4,916,295 | 4/1990 | Chominski . | |
| 4,977,583 | 12/1990 | Gorgone . | |
| 5,019,249 | 5/1991 | Sugai et al. . | |
| 5,020,110 | 5/1991 | Chominski . | |
| 5,058,365 | 10/1991 | Kagi . | |
| 5,110,105 | 5/1992 | Nicoll et al. . | |
| 5,112,040 | 5/1992 | Johnston et al. . | |
| 5,126,002 | 6/1992 | Iwata et al. | 53/586 X |
| 5,138,817 | 8/1992 | Mowry et al. . | |
| 5,218,813 | 6/1993 | Seidel . | |
| 5,251,738 | 10/1993 | Dabrowski . | |
| 5,271,613 | 12/1993 | Hain . | |
| 5,288,066 | 2/1994 | Hain . | |
| 5,405,131 | 4/1995 | Zouzoulas . | |
| 5,411,249 | 5/1995 | Zouzoulas . | |
| 5,419,457 | 5/1995 | Ross et al. . | |
| 5,457,938 | 10/1995 | Butterfield et al. . | |
| 5,499,489 | 3/1996 | Perobelli et al. . | |

CURRENCY STRAPPING MACHINE

TECHNICAL FIELD OF THE INVENTION

The present invention relates in general to equipment for processing currency documents, and in particular to an apparatus for automatically feeding, inspecting, sorting and binding the documents into bundles with a strapping tape.

BACKGROUND OF THE INVENTION

Prior art equipment has been used for automatically feeding, inspecting, authenticating, counting and sorting currency documents, such as bank notes. Document feeders were provided with infrared sensors for determining various positions for a document feeder arm which moved a stack of documents into a reciprocating feeder plate. A vacuum was applied to holes in the feeder plate for pulling singular documents against the feeder plate. A vacuum was also applied to a separator head, which faced opposite the feeder plate and separated documents from the singular documents being pulled by the feeder plate into transport conveyors. The documents passed, one at a time, between the feeder plate and separator head to transport conveyors.

The transport conveyors carried the documents past various devices for inspecting the condition and determining the currency value of the documents. The documents were sorted according to document condition and currency value, and stacked in appropriate discharge bins. The documents were then moved to another location at which they were bound with a strapping tape. The documents were often manually moved from discharge bins to a strapping station where the documents were bound.

SUMMARY OF THE INVENTION

The present invention disclosed and claimed herein comprises a method and apparatus for automatically feeding, inspecting, authenticating, sorting, counting and stacking currency documents, and then binding the documents into document bundles with strapping tape. A stack of loose currency documents is placed on a tray of a document feeder and automatically fed, one at a time, into a transport conveyor. The document feeder includes a lever arm connected to a potentiometer for determining various positions of a feeder arm, which pushes the stack of documents across the tray and into a continuous vacuum feed belt. The vacuum feed belt then pulls documents from an inward end of the stack and moves the documents past a vacuum separator head. The vacuum separator head separates documents from the document closest to the vacuum feed belt. The vacuum feed belt and the vacuum separator head are connected to the same vacuum supply so that the vacuum in the separator head increases when documents are pulled against the side of the vacuum feed belt. Documents are fed, one document at a time, from the vacuum feed belt into a transport conveyor which passes the documents through inspection and sorting stations. Documents are sorted and then stacked on appropriate platens, which are included within a strapping unit for binding the documents into bundles with the strapping tape.

In another aspect of the present invention, after a selected number of documents are stacked upon a particular platen, a strapping tape is wrapped around three sides of the documents. The strapping tape is wrapped around the three sides by first feeding a terminal end of the strapping tape through a channel in the platen, which is disposed adjacent to an inner side of the documents. Then the terminal end is passed around a second side by being passed through a channel in a turn-around head which extends along a first end of the documents. Then the terminal end of the strapping tape is extended along the third side of the documents by the shape of the channel in the turn-around head causing the terminal end to pass along an outward side of the documents.

In yet another aspect of the present invention, the strapping tape is then wrapped around the fourth side of the documents by rotating the documents approximately 90 degrees in the same angular direction in which the terminal end of the strapping tape is passed around the first three sides of the documents. To rotate the documents, a retaining arm is retracted to push the strapping tape against the outward side of the documents, to clamp both the strapping tape to the documents and the documents to the platen. Then the platen is rotated approximately 90 degrees in the same direction that the terminal end of the tape is fed around the documents, while additional strapping tape is fed to allow rotation of the platen.

In a further aspect of the present invention, a weld head is then extended from a retracted position to compact the documents and to press the inward length of the strapping tape against a portion of the strapping tape extending from the terminal end. A heating coil in the weld head fuses the inward length end of the strapping tape to the terminal end portion of strapping tape to bind the documents into a document bundle. The strapping tape is cut inward of the inward length of the tape and the weld head is retracted. The document bundle is then dropped into a discharge bin.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
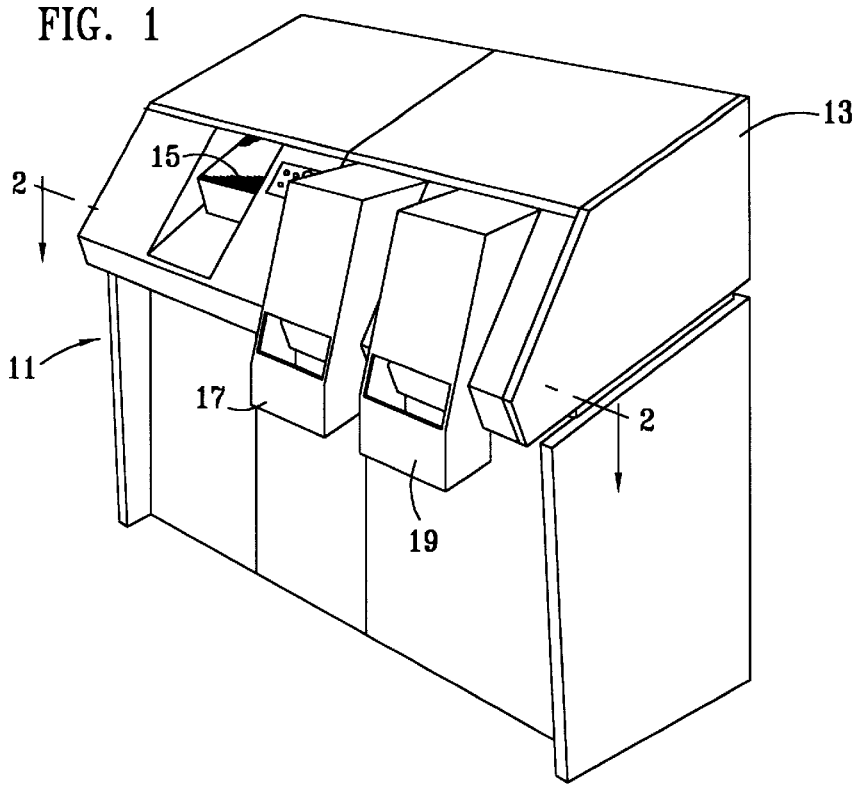
FIG. 1 is a perspective view of an apparatus for processing currency documents according to the present invention.

FIG. 1 is a perspective view of apparatus 11 for processing currency documents according to the present invention. Currency processing unit 11 includes a cabinet 13. Loose currency documents are placed into feed tray 15 located in a feed bin, then they are automatically fed into processing unit 11 where they are automatically inspected for tears, soiling and wear, and then sorted into different stacks according to document type. In other embodiments, a currency cassette may be used for feeding documents into processing unit 11, such as the cassette shown in the prior filed and commonly owned pending U.S. patent application Ser. No. 08/609,170, filed Mar. 1, 1996 and entitled "Currency Cassette System", which is hereby incorporated by reference as fully set forth herein. The stacks of currency documents are then automatically wrapped with a strapping tape and bound together in document bundles, which are discharged into bins 17 and 19.

Figure 2:
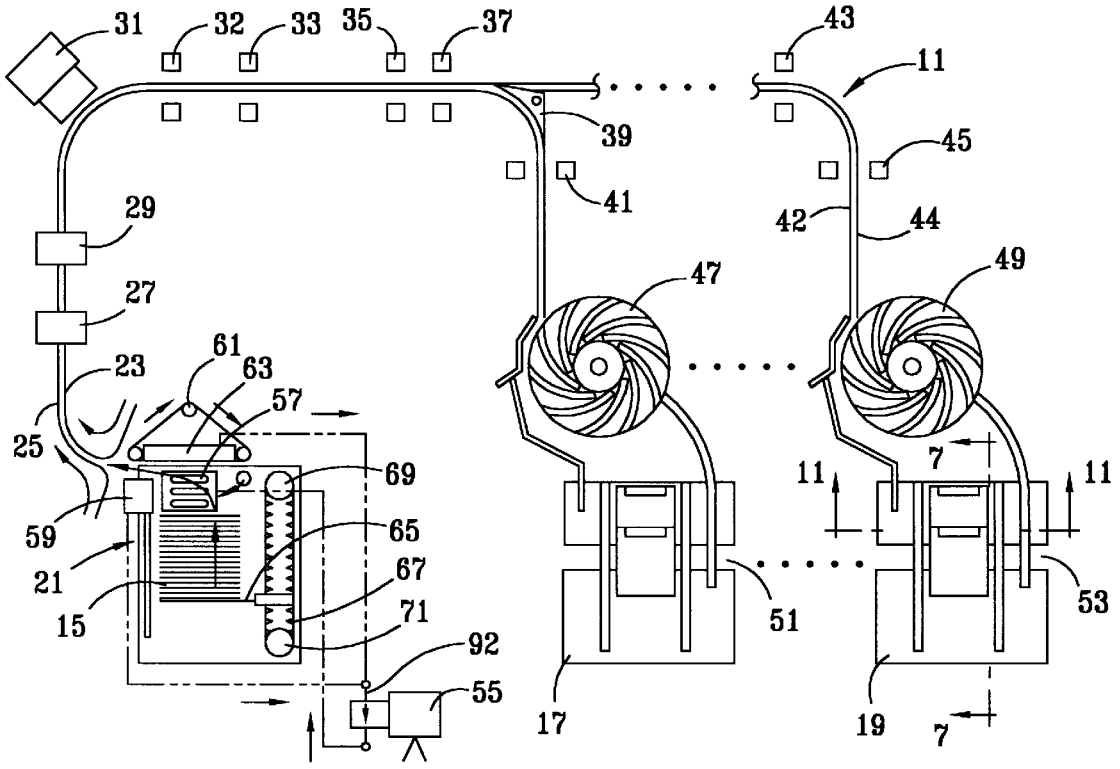
FIG. 2 is sectional view which schematically illustrates the apparatus for processing currency documents, taken along section line 2—2 of FIG. 1.

FIG. 2 is a sectional schematic view of currency document processor 11, taken along section line 2—2 of FIG. 1. Feeder 21 automatically feeds documents from feed tray 15 into continuous transport belts 23 and 25. All of the document transport conveyor belts of unit 11, such as transport belts 23 and 25, are powered by a single, synchronous A.C. motor to synchronize the speeds of various transport belts. Continuous transport belts 23 and 25 have vertically disposed surfaces which transport singular documents, one at a time, past infrared (IR) scanner 27, capacitance scanner 29 and IR reflectance scanner 31.

IR scanner 27 is a transmissive infrared detector which determines the length and width of the documents, as well as whether there are any tears or holes in the documents. Capacitance scanner 29 determines whether tape and other materials are adhered to the documents, and detects whether more than one document is being fed at a time. IR reflectance scanner 31 is an infrared scanner which determines the amount of soiling of the documents by determining the intensity of infrared light reflected by the documents. IR reflectance scanner 31 also maps detected pixels of the returned images from infrared light reflected by the documents for determining the document type for sorting, this being a form of template matching which allows determination of currency denomination. Documents are typically typed and sorted into various discharge bins according to currency denomination, such as 5's, 10's and 20's. Documents which are excessively worn will be sorted to a separate reject bin. Authentication detector 32 then determines whether the currency notes are authentic. Authentication detector 32 will typically be of a type which is a function of the particular currency, such as a magnetic type detector, phosphorescent type detector and the like.

Documents will pass between IR detectors 33 and 35, which are utilized for transport timing. A shuttle gate IR detector 37 then detects when the leading edge of a document is approaching a shuttle gate 39. For example, if a particular document is being sorted into bin 17, shuttle gate 39 will be actuated to open so that the document will feed toward bin 17 and not bin 19. Shuttle gate 39 is powered by a very fast, limited range D.C. motor, manufactured. If instead of being sorted into discharge bin 17, a particular document is being sorted into discharge bin 19, it will pass above shuttle gate 39, between transport belts 42 and 44 and toward bin 19. Stacker wheels 47 and 49 are provided for stacking sorted documents into strapping units 51 and 53, respectively. As will be discussed below in more detail, documents stacked upon strapping units 51 and 53 will be bound by a strapping tape into document bundles.

Referring further to FIG. 2 in more detail, loose document feeder 21 includes air ports 57 which receive supply air from a rotary vane vacuum pump 55. Vacuum pump 55 provides both supply air to air ports 57, and vacuum to a vacuum separator head 59 and a vacuum manifold 63. Continuous vacuum belt 61 is provided which is a perforated belt that passes over vacuum manifold 63, and the vacuum within vacuum manifold 63 is drawn through the perforations in continuous vacuum belt 61. A feeder arm 65 is driven by a cogged belt 67, which is driven by drive pulleys 69 and 71 for moving documents toward a vacuum separator head 59 and continuous vacuum belt 61.

Figure 3:
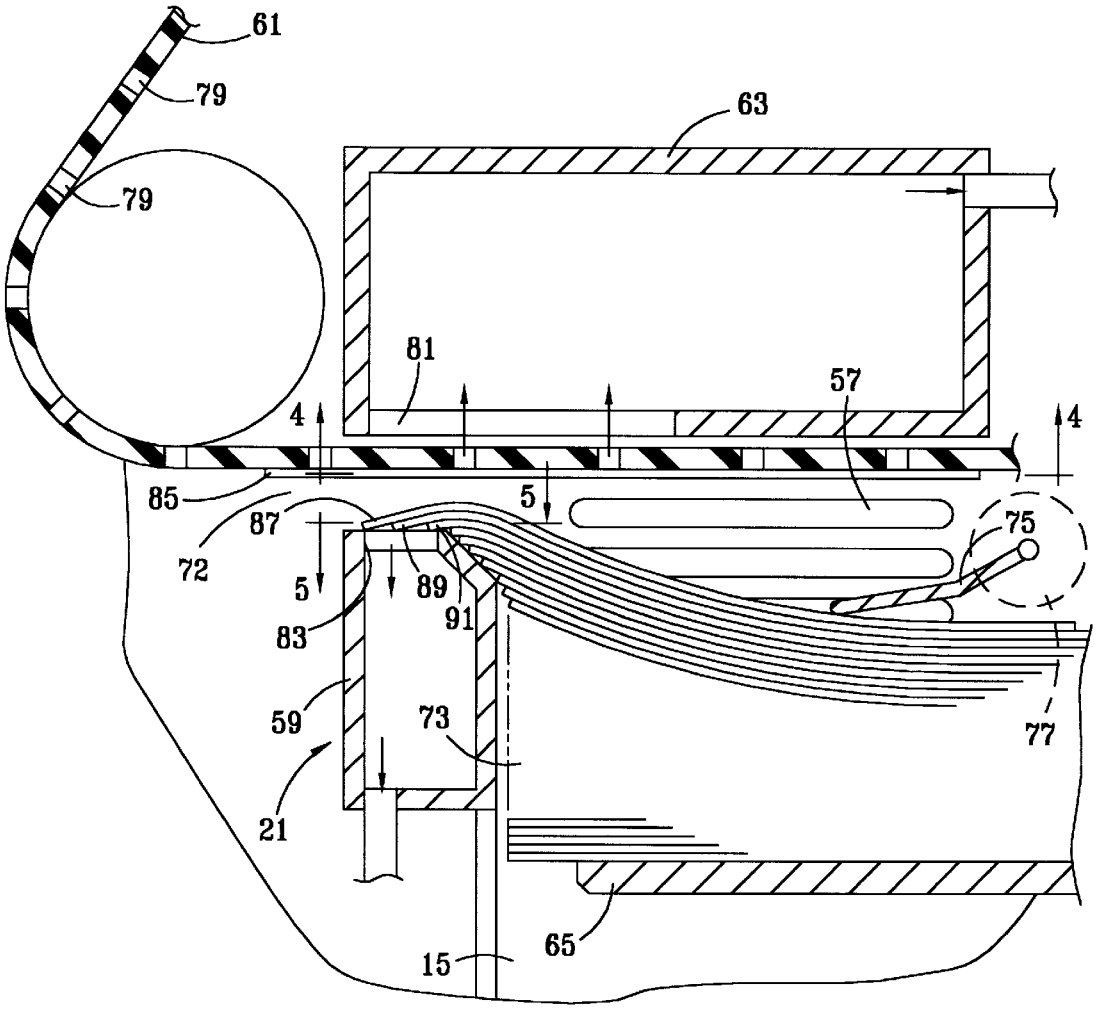
FIG. 3 is a detailed partial sectional view depicting the feeder assembly of the apparatus of the present invention, taken along the plane of FIG. 2.

FIG. 3 depicts the automatic feeder 21 of currency document processor 11 in more detail. Continuous vacuum belt 61 and separator head 59 are spaced apart by a document feed gap 72. A plurality of loose currency documents 73 are placed onto feed tray 15 and pushed toward vacuum belt 61 and vacuum manifold 63 by feeder arm 65. Feeder arm 65 is preferably a flat plate which extends transverse to the view of FIG. 3 to provide a feeder member for moving the loose documents 73 stacked on feed tray 15. The positioning of feeder arm 65 is controlled by the combination of a lever arm 75 and a potentiometer 77, which sense the distance between continuous vacuum belt 61 and an inward end of the stack of loose currency documents 73.

Figure 4:
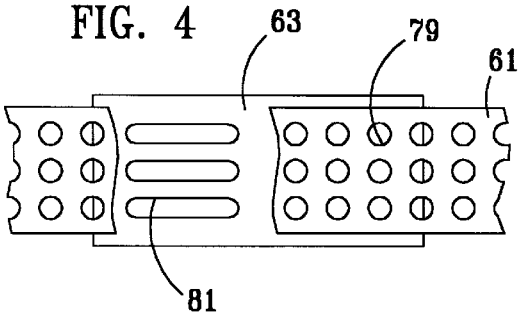
FIG. 4 is a partial cut-away view of a vacuum feed belt and a vacuum manifold of a feeder assembly, taken along section line 4—4 of FIG. 3.

FIG. 4 is a partial cut-away view of continuous vacuum belt 61 and vacuum manifold 63, taken along section line 4—4 of FIG. 3. Vacuum holes 79 extend through continuous belt 61. Vacuum slots 81 extend into vacuum manifold 63. As vacuum holes 79 in continuous vacuum belt 61 pass across slots 81 of vacuum manifold 63, a vacuum is drawn across vacuum holes 79.

Referring again to FIG. 3, air blowing upward through air ports 57 will help to separate a currency document 85 from a currency document 87. Currency document 85 is the inward most one, or the uppermost one, of currency documents 73, being the closest to continuous vacuum belt 61. Currency document 85 will be pulled against continuous vacuum belt 61 by the vacuum drawn through vacuum holes 79 and slots 81 in vacuum manifold 63.

Figure 5:
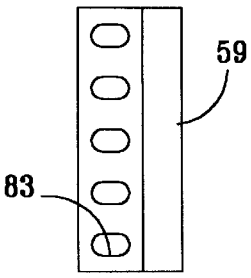
FIG. 5 is a side view of a vacuum separator head of a feeder assembly, viewed along section 5—5 of FIG. 3.

FIG. 5 is a side view of vacuum separator head 59, viewed along section line 5—5 of FIG. 3. Vacuum separator head 59 is a vacuum manifold which includes vacuum ports 83. As currency document 85 is being automatically fed by continuous vacuum belt 61 into document feed gap 72 (shown in FIG. 3), friction with document 85 and stack 73 will cause the next several documents, such as currency documents 87, 89 and 91, to separate from one another so that their leading edges are staggered and separately extend across vacuum ports 83 of vacuum separator head 59. The leading edges of currency documents 87, 89 and 91 are fanned out; that is, spaced apart along the longitudinal direction of the document feed path. The vacuum being drawn across vacuum ports 83 draws the leading end portions of currency documents 87, 89 and 91 against vacuum separator head 59.

Vacuum manifold 63 and vacuum separator head 59 are connected to a common vacuum supply line 92 so that the vacuum within vacuum separator head 59 will greatly increase when currency document 85 is pulled against continuous vacuum belt 61 such that slots 81 in vacuum manifold 63 are blocked by currency document 85. With increasing vacuum within vacuum separator head 59, currency documents 87, 89 and 91 are drawn that much harder against vacuum separator head 59. Connecting vacuum separator 59 and vacuum manifold 63 to a singular vacuum supply line thus provides for more reliable feeding of one document at a time.

Figure 6:
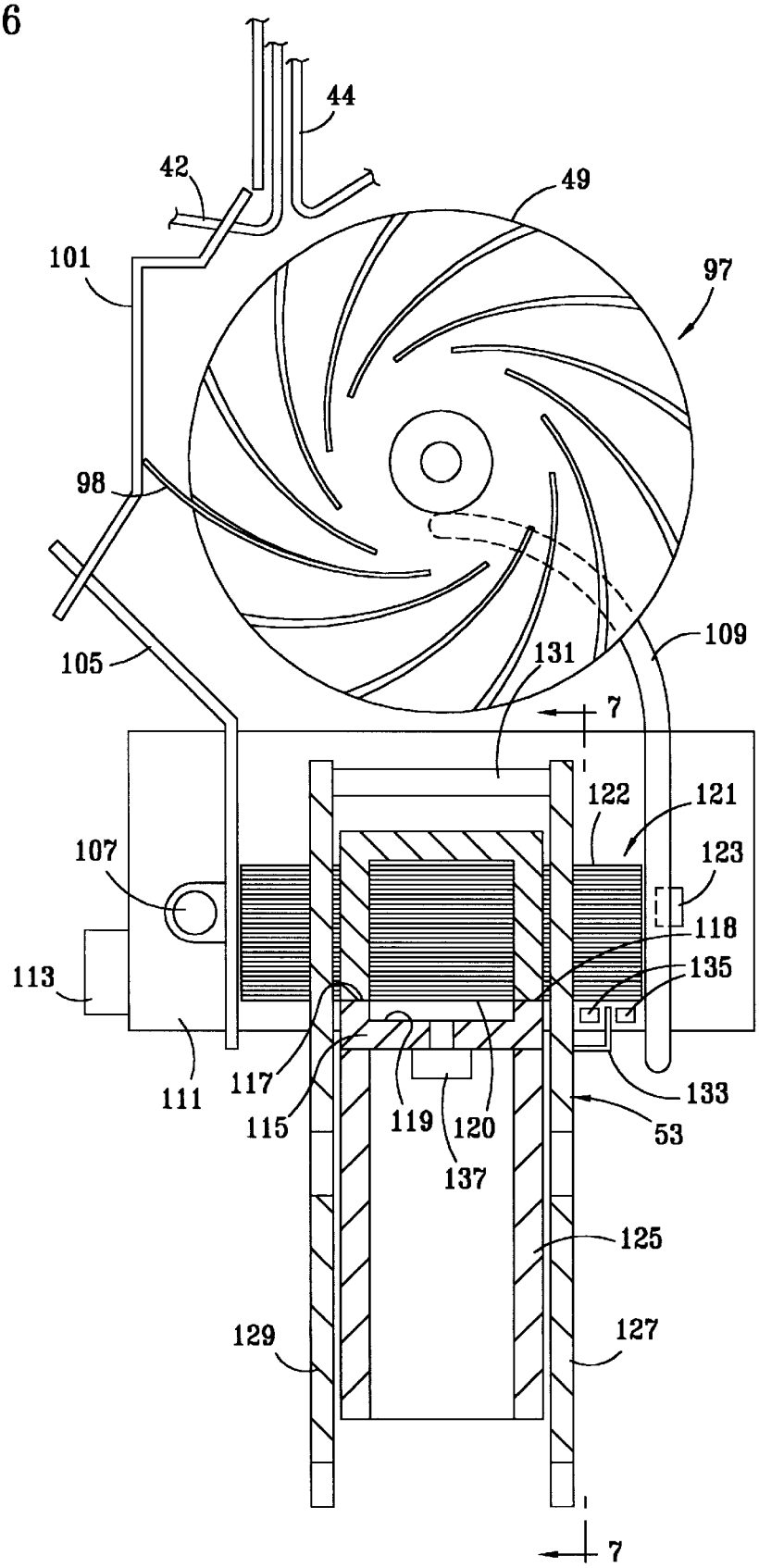
FIG. 6 is a detailed partial sectional view depicting a stacker and strapping unit of the present invention, taken along the plane of FIG. 2.

FIG. 6 is a detailed partial section view depicting stacking unit 97 and strapper unit 53, taken along the plane of FIG. 2. Documents are fed from between continuous transport belts 42 and 44 into stacker wheel 49, with the documents standing upright, or on edge, so that their lengths extend in a horizontal direction and their widths extend in a vertical direction. Then, as viewed in FIG. 6, stacker wheel 49 is rotated counterclockwise by a stepper motor and passes the edges of documents, such as a document 98, by a guide plate 101 and a guide plate 105. Guide plate 105 has an adjustment knob 107 for adjusting guide plate 105 to accommodate different lengths of bank documents. An arm 109 extends within stacker wheel 49, and has a curved, concave surface for guiding documents out of stacker wheel 49 and onto stacking deck 111. Movement of stacker wheel 49 in conjunction with arm 109 and guide plate 105 will cause currency documents 121 to be stacked upon stacking deck 111.

Stacking deck 111 is a vibratory plate, having a vibrator 113 for vibrating documents 121 so that their lower edges will rest against stacking deck 111. Vibrator 113 is preferably a small motor having an eccentric bearing to create mechanical vibrations. Documents 121 are stacked with their edges against stacking deck 111, and their inward sides facing platen 115, with an innermost side 120 laying on top of platen 115. Platen 115 is preferably not a flat plate, but rather it has surfaces 117 and 118 against which documents 121 are stacked. Channel 119 extends within platen 115 and passes along inward side 120 of documents 121. Outward side 122 faces opposite inward side 120; that is, it faces away from platen 115. Mounted beneath arm 109 is a reflective IR detector 123. Reflective IR detector 123 determines when more than fifty (50) documents have been stacked against platen 115, on top of stacking deck 111.

Platen 115 is mounted to a platen carriage 125. Racks 127 and 129 are extensible support members which are moveably mounted on respective sides of platen carriage 125. The forward end of racks 127 and 129 are connected together by a retaining arm 131. Retaining arm 131 is preferably a round rod. When platen carriage 125 is in the home position depicted in FIG. 6, tab 133 extends from platen carriage 125 and between two components of transmissive IR sensor 135. IR sensor 135 is a platen home position sensor. Tab 133 will only extend between the two components of IR sensor 135 when platen 115 is in the home position.

A tape over IR sensor 137 is mounted on the inward side of platen 115. IR sensor 137 is a reflective sensor provided for detecting when strapping tape is disposed within channel 119. A hole extends through platen 115, adjacent to tape over reflective sensor 137, so that IR sensor 137 can determine when strapping tape is disposed within channel 119.

Figure 7:
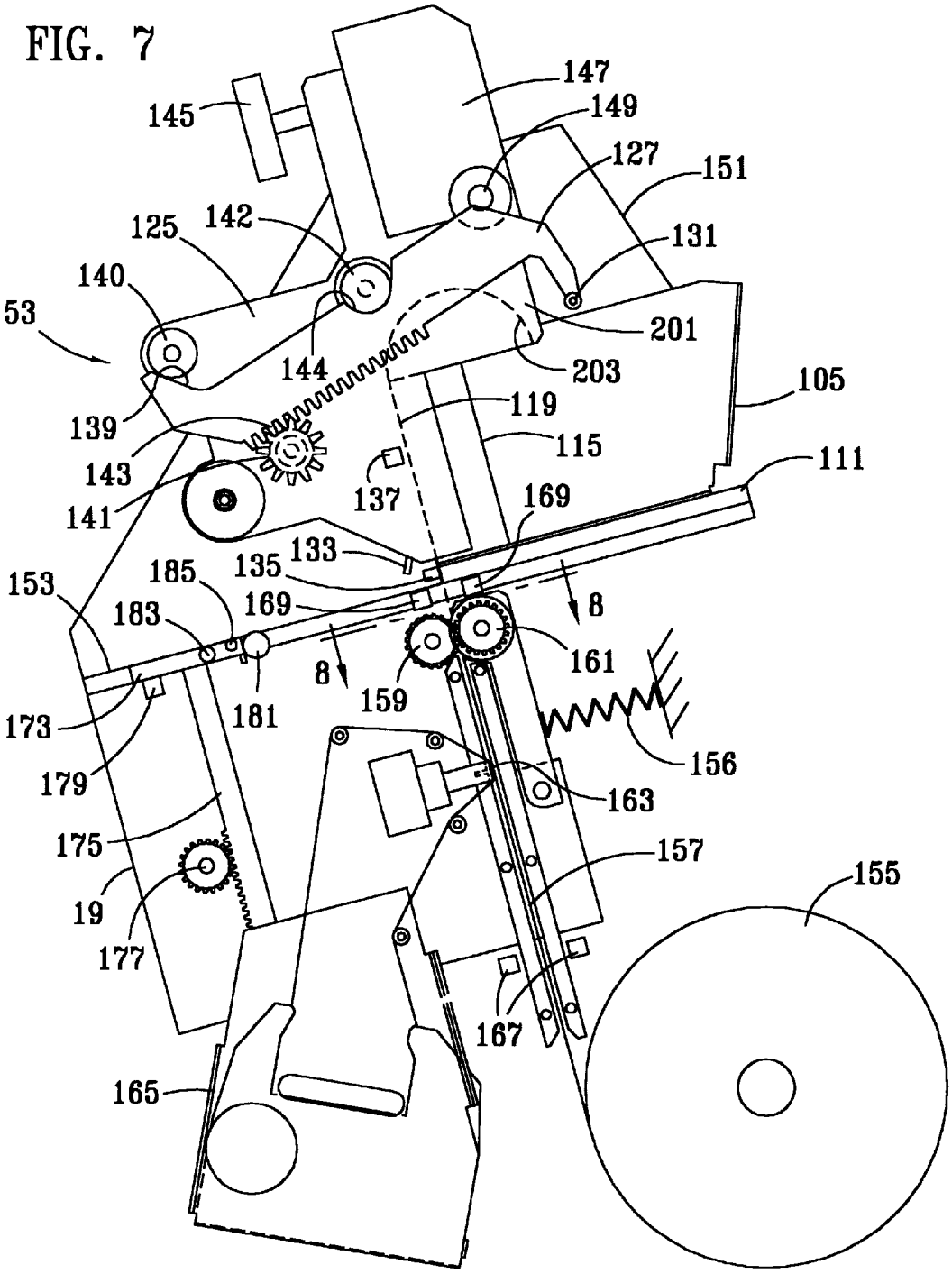
FIG. 7 is a partial section, elevational view of a strapping unit, taken along section line 7—7 of FIG. 2.

FIG. 7 is a partial section, elevational view of strapping unit 53, taken along section line 7—7 of FIG. 2. Each of racks 127 and 129 (shown in FIG. 6) have a cam surface similar to cam surface 139 of rack 127 which engages a roller, such as roller 140. Drive sprocket 141 is provided for engaging teeth 143 of rack 129. Drive sprocket 141 is powered by a D.C. motor. Bearing surface 144 receives roller 142 to allow retaining arm 131 to be moved up into the raised position shown in FIG. 7. When racks 127 and 129 (shown in FIG. 6) are disposed in the raised position, retaining arm 131 is raised so that documents 121 may be individually stacked upon platen 115 without engaging retaining arm 131.

Platen carriage 125 has a platen height adjustment knob 145 for adjusting the distance between platen 115 and stacking deck 111 to accommodate different heights of documents. This adjusts the height of turn-around head 201 from vibratory stacking deck 111. The uppermost edge of documents 121 fit underneath the lower surface of turn around head 201. Vibrations from vibratory stacking deck 111 cause the lower edges of the documents 121 to rest flush against deck 111 and the upper edges of documents 121 to rest flush against the lower surface of turnaround head 201. Platen carriage 125 is rigidly mounted to rotator bar 147 by tightening platen height adjustment knob 145. Shaft 149 is mounted to stationary frame 151. Rotator bar 147 is mounted to shaft 149, and rotates with shaft 149 to preferably rotate platen carriage 125 and platen 115 approximately 90 degrees about an axial centerline axis extending longitudinally through shaft 149.

Cover plate 153 provides a plate which extends across discharge bin 19. Plate 153 guides document bundles, which have been strapped together, into discharge bin 19. A reel, or spool, of tape 155 is mounted to a shaft beneath deck 111. Tape 155 extends upward through tape feed guide 157 to power rollers 159 and 161. Rollers 159 and 161 are rigidly mounted to two shafts 164 and 168 (shown in FIG. 8), which are coupled together by gears and powered by a stepper motor for feeding and retracting tape 155. Compression spring 156 is mounted for pressing roller 161 into roller 159. Compression spring 156 exerts roughly 6 pounds of force, with approximately ¼ of the 6 pounds of force pressing roller 161 into roller 159.

Figure 8:
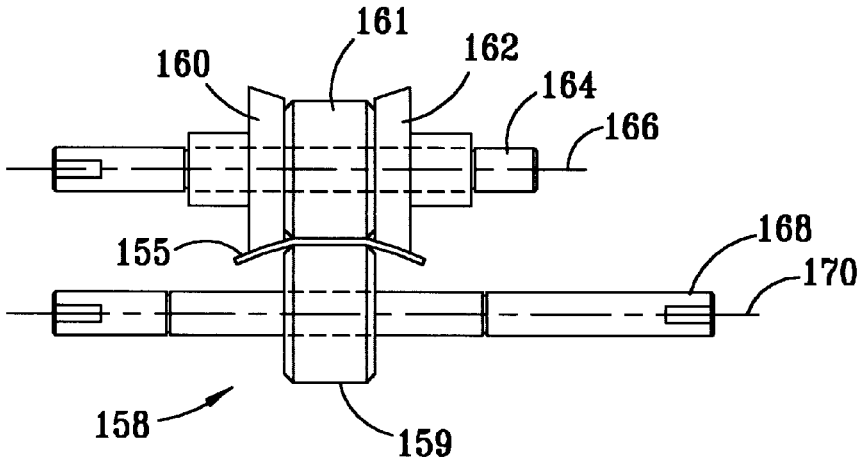
FIG. 8 is a partial section view of a powered roller, tape dispenser of the present invention, taken along section line 8—8 of FIG. 7.

FIG. 8 is a partial section view taken along section line 8—8 of FIG. 7, and depicts powered roller assembly 158. Roller assembly 158 includes power rollers 159 and 161, which are depicted with strapping tape 155 disposed therebetween. Rollers 159 and 161 are formed of 80 durometer urethane. Rollers 159 and 161 are rigidly mounted to shafts 168 and 164 for rotating about longitudinal axes 170 and 166, respectively. Shafts 164 and 168 are coupled together by the gears shown in FIG. 7. Roller assembly 158 further includes frustroconically shaped rollers 160 and 162, which are also rigidly mounted to shaft 164 and rotate with roller 161 to power movement strapping tape 155. The smaller frustroconical ends of rollers 160 and 162 face one another and fit against opposite ends of roller 161. Rollers 160 and 162 are preferably formed of delrin plastic.

Frustroconical rollers 160 and 162, and rollers 159 and 161 operate to bend, or fold, strapping tape 155 so that it is curved in a transverse direction to the longitudinal length of strapping tape 155, as shown in FIG. 8. Preferably, tape 155 is bent, or curved, so that the concave side of tape 155 faces inward within channel 119, facing towards sensor 137 without a crease in strapping tape 155. Bending strapping tape 155 in a direction which is transverse to its length increases the columnar strength of strapping tape 155, over that in a flat position, so that it may be pushed upward from between power rollers 159 and 161 and into channel 119 of platen 115. In the preferred embodiment, strapping tape 159 is preferably 1⅛ inches wide. Strapping unit 53 of FIG. 7 may often be configured so that platen 115 is up to 1½ inches above the pinch point of power rollers 159 and 161. Bending strapping tape 155 gives it enough columnar strength so that is may be pushed, in a lengthwise direction with respect to strapping tape 155, across a 1½ inch gap above the pinch point of power rolls 159 and 161, and into guide channel 119 of platen 115.

Print head 163 extends adjacent to tape feed guide 157. Print head 163 is preferably an eight (8) pin print head. Ink ribbon cartridge 165 is disposed beneath print head 163 and provides an ink ribbon for passing adjacent to print head 163, between print head 163 and a portion of tape 155 within tape feed guide 157. The ink ribbon of cartridge 165 is driven by a D.C. motor. Power rollers 159 and 161 are driven by a stepper motor such that the feed rate of tape 155 past print head 163 will be known, and then print head 163 can be controlled for printing on tape 155 as tape 155 is fed upward within tape feed guide 157. Thus, notations can be made on the strapping tape which is being used to bind the document into bundles. For example, if the denomination of each of the currency documents in a bundle is $5.00, then $5.00 can be printed on the strapping tape binding the bills, as well as the total quantity of the currency documents make up the document bundle.

Below deck IR sensor 167 is mounted at the lower end of tape feed guide 157 for determining if strapping tape 155 is present at the lower portion of tape feed guide 157. Above deck IR sensor 169 is provided immediately above power rollers 159 and 161 for sensing the presence of strapping tape 155. Above deck IR sensor 169 is preferably used as a home position sensor for terminal end 171 of tape 155. Additionally, IR above deck sensor 169 can be used in combination with tape over reflective IR sensor 137 to determine the height of platen 115 above deck 111. Since a stepper motor is used for driving power rollers 159 and 161, the angular displacement over which the stepper motor is operated can be used to determine how much tape is being fed when terminal end 171 passes from above deck IR sensor 169 to tape over IR sensor 137. The number of steps that the stepper motor is operated is counted, and then the height at which platen 115 is set for accommodating the width of the currency documents is determined from the counted number of steps.

A weld head 173, when in the home position, is disposed flush with cover plate 153, as shown in FIG. 7. Weld head 173 is provided for pushing against strapping tape 155, welding the strapping tape together to bind documents together in a bundle, and then cutting the inward length of strapping tape from the document bundle. Weld head 173 is mounted to rack 175. Rack 175 has teeth which engage drive gear 177 for extending weld head 173 outward and above cover plate 153. Drive gear 177 is preferably powered by a stepper motor. Weld head home IR sensor 179 detects when weld head 173 is in the home position depicted in FIG. 7.

Figure 9:
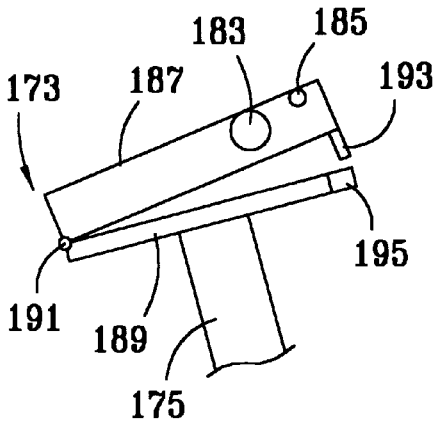
FIGS. 9 and 10 are side elevational views which schematically depict a weld head of a strapping unit.
Figure 10:
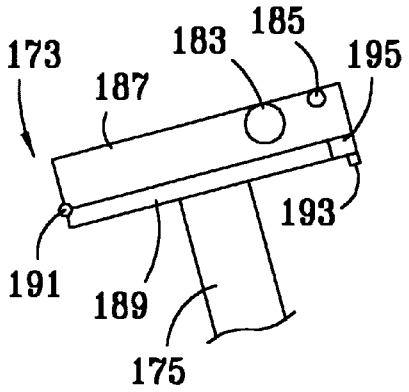
Figure 16:
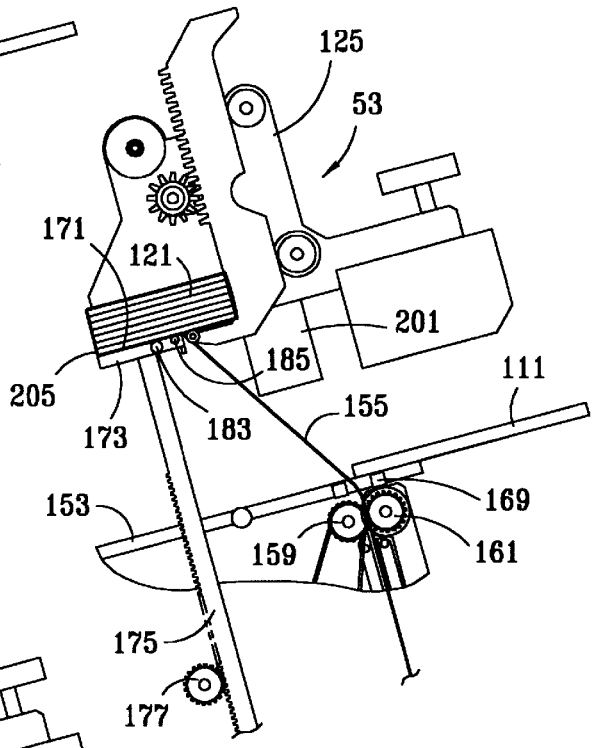

FIGS. 9 and 10 schematically depict a partial side elevational view of weld head 173 and an upper portion of rack 175, viewed along section line 7—7 of FIG. 2. Weld head 173 includes heating coil 183 and cutting wire 185, which are both formed of nichrome wire. Heating coil 183 and cutting wire 185 extend transversely to the plane of FIG. 9. Weld head 173 includes members 187 and 189 which are hinged together at point 191. A resilient means, such as a spring, is provided for urging member 187 away from member 189, into the spaced apart position shown in FIG. 9. When rack 175 is extended to push weld head 173 against a stack of documents, as depicted in FIG. 16 and discussed below in more detail, member 187 will move to the position relative to member 189 shown in FIG. 10, fitting flush against member 189. When this occurs, tab 193 will extend between the tape against document IR transmissive sensor 195 to register that member 187 has been pushed against the documents. The number of steps for operating the stepper motor used for extending rack 175 from the home position to the tape against the documents position is also counted so that operation of document processing unit 11 may be suspended and an alarm signaled if sensor 195 is not activated within an expected number of steps of the stepper motor. After rack 175 is retracted, member 187 will again pull away from member 189 causing tab 193 to be withdrawn from between IR sensor 195.

Figure 11:
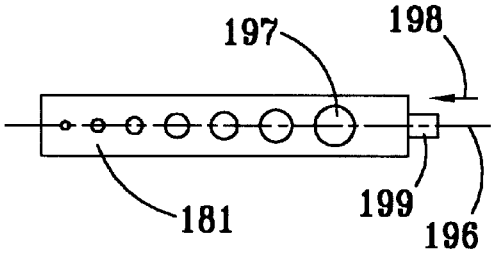
FIG. 11 is an elevational view of cooling tube for use in a strapping unit, taken along section line 11—11 of FIG. 2.

FIG. 11 is a side elevational view of air tube 181, taken along section line 11—11 of FIG. 2. Air tube 181 has longitudinal axis 196, and is preferably formed of ⅝ inch O.D. aluminum tubing having a 0.093 inch wall thickness. Six air ports 197 extend through the sidewall of air tube 181, transverse to longitudinal axis 196, over a length of 1¼ inches which extends parallel to longitudinal axis 196. The six air ports 197 are spaced apart in a direction parallel to longitudinal axis 196, and are preferably sized to have diameters of ⅛", 9/64", 5/32", 3/16", 7/32" and ¼", respectively, which decrease in size as they are disposed further away from air inlet 199. Adjacent edges of the ports 197 are spaced apart equal distances. The diameters of air ports 197 decrease in size as they are disposed further away from air inlet 199 so that the air will be blown through each of the air ports 197 in a straight direction which is roughly perpendicular to longitudinal axis 196 of air tube 181.

The air passes through air inlet 199 in direction 198, which is preferably parallel to longitudinal axis 196. If air ports 197 were configured to increase in size in an opposite direction to that shown in FIG. 11, then most of the air would tend to be blown from the largest of ports 197 in a direction which is at an acute angle to longitudinal axis 196, extending in the same direction as the air passing through air inlet 199. If air ports 197 were to be of the same diameter, then air would tend to not pass through some of ports 197. If air ports 197 were made larger, or in the shape of a slot, air would tend to pass from the largest of the ports at an acute angle to longitudinal axis 196, continuing to move in the same direction as the air passing through air inlet 199. The air pressure at air inlet 199 is approximately 22 inches of water, with air supplied by ½ inch tubing.

Air which is blown from air ports 197 passes across heating coil 183 and cutting wire 185 after weld head 173 is moved to the retracted, home position flush with cover plate 153. This provides uniform cooling across the length of heating coil 183, which extends parallel to the length of the air tube 181. Blowing air across heating coil 183 and cutting wire 185 decreases the amount of time required for cooling heating coil 183 and cutting wire 185 prior to extending weld head 173 to push against tape 155 and documents 121 in a later cycle. Heating coil 183 and cutting wire 185 must be cooled from their operating temperatures or they will cut tape 155 as tape 155 is being tensioned while weld head 173 is pressed against the documents. Decreasing the cooling time of coil 183 and wire 185 decreases the cycle time of strapping unit 53. When weld head 173 is disposed in the home position, flush with cover plate 153, air tube 181 extends adjacent to weld head 173 for passing air from ports 197 across weld head 173 between weld and cut cycles. Air tube 181 blowing air across heating coil 183 reduces the amount of time required for cooling heating coil 183, decreasing the cycle time at which strapping unit 53 can be operated. Without air tube 181, weld head 173 can only be operated approximately once every 20 seconds without damaging strapping tape 155 as rack 175 is extended to push weld head 173 against tape 155 and documents 123. However, with air tube 181, the minimum cycle time between document strapping cycles is reduced from twenty (20) seconds to approximately eight (8) seconds.

Figure 12:
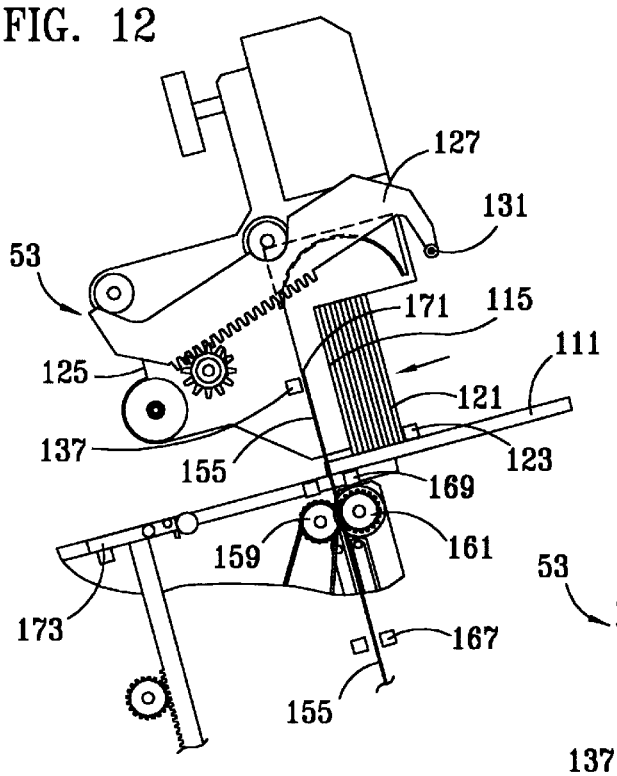
FIGS. 12 through 17 are side elevational, partial sectional views which schematically depict operation of a strapping unit, taken along section line 7—7 of FIG. 2.

FIGS. 12 through 17 are partial side elevational views, taken along section line 7—7 of FIG. 2, and schematically depict operation of strapping unit 53 for binding the documents into a bundle. FIG. 12 depicts stacker unit 53 as documents are being stacked on top of vibratory deck 11 and against platen 115. Terminal end 171 of tape 155 has been moved from the home position, adjacent to above deck sensor 169, to the tape over position, adjacent to IR sensor 137. A stepper motor drives power rollers 159 and 161 to feed tape upwards from above deck infrared sensor 169 to tape over infrared sensor 137. The distance that rollers 159 and 161 move tape end 171 in traveling from sensor 169 to sensor 137 is preferably determined by counting the number of steps over which the stepper motor driving power rollers 159 and 161 is operated. The number of steps counted is used to determine the height of platen 115 above deck 111.

As shown in FIG. 12, weld head 173 is disposed in the home position. Rack 127 is in the extended position so that retaining arm 131 is raised above the path through which documents pass in stacking against platen 15 on deck 111. Documents are stacked at least until they extend adjacent to reflective infrared sensor 123. Preferably a minimum of fifty (50) documents must be present to activate reflective sensor 123. A predetermined number of more than fifty (50) documents may be stacked prior to binding the documents into a bundle.

Figure 13:
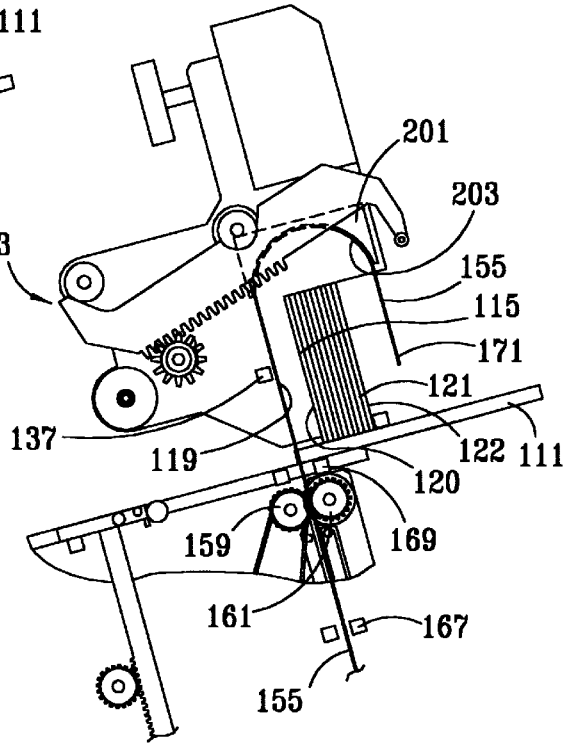

FIG. 13 depicts stacker unit 53 after terminal end 171 of tape 155 has been moved around three (3) sides of documents 121. After documents 121 have been stacked against platen 115 and on top of deck 111, power rollers 159 and 161 will be operated to feed tape 155 outward which angularly displaces tape end 171 clockwise around three (3) sides of documents 121. Power rollers 159 and 161 will extend tape 155 so that terminal end 171 of tape 155 moves around inward side 120, first end 202 and outward side 122 in moving from the tape over position of FIG. 12 to the position shown in FIG. 13. End 171 is preferably disposed about one-half (½) inch above deck 111. The number of counts for operating the stepper motor for powering rollers 159 and 161 to move terminal end 171 from the tape over position of FIG. 12 to the position shown in FIG. 13 is computed by knowing the fixed dimensions of channel 119 of platen 115 and channel 203 of turn around head 201, in combination with knowing the previously determined distance from above deck sensor 169 to tape over sensor 137. As discussed above, the distance from platen 115 to deck 111 was computed in counting the number of steps required to move tape end 171 from the tape home position, adjacent to above deck sensor 169, to the tape over sensor 137 (shown in FIG. 7).

Referring to FIGS. 7 and 13, turn around head 201 is mounted above platen 115. Turn around head 201 has a curved, arcuate surface 203 which defines a strapping tape turn around channel which fits flush with the upper end of channel 119 of platen 115. Arcuate surface 203 guides terminal end 171 of strapping tape 155 when strapping tape 155 is extended into turn around head 201, and turns terminal end 171 around end 202 of documents 121, wrapping strapping tape 155 around three (3) sides of the stack of documents 121. In operation, terminal end 171 of tape 155 is extended from above deck IR sensor 137, through the upper end of channel 119 of platen 115, and into arcuate surface 203 of turn around head 201. This wraps strapping tape 155 around inward side 120, first end 202 and outward side 122 of documents 121.

Figure 14:
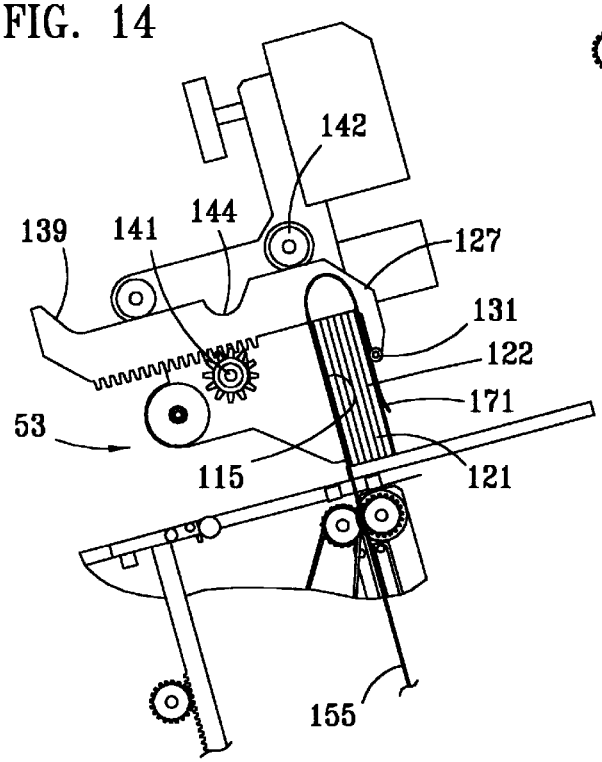

FIG. 14 depicts strapping unit 53 with retainer arm 131 having been retracted to clamp tape 155 against documents 121 and to push documents 121 against platen 115. Drive sprocket 141 has been operated to move rack 127 and 129 (shown in FIG. 6) rearward, causing bearing surface 144 to disengage from roller 142 and cam surface 139 to move rearward of roller 141. This moves retainer arm 131 against outward side 122 of documents 121, trapping tape 155 against outward side 122 of documents 121. Retainer arm 131 is preferably pulled back against tape 155 and documents 121 with five to seven pounds of force.

Figure 15:
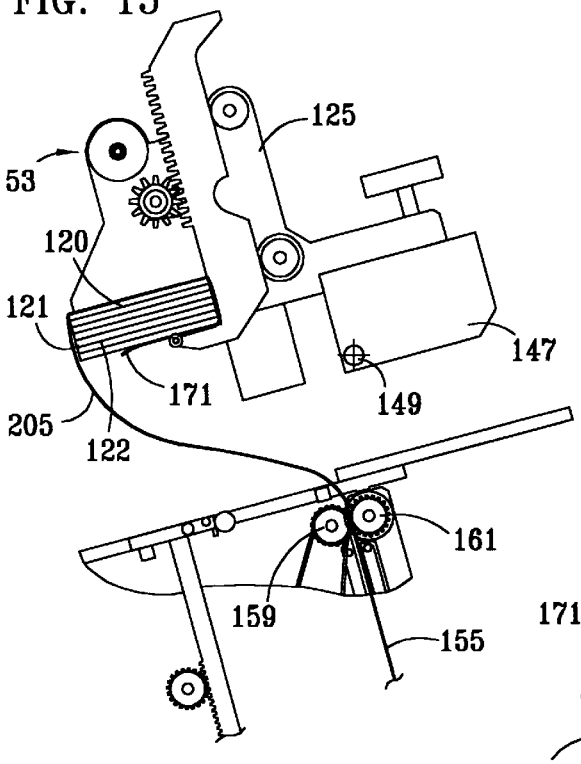

FIG. 15 depicts platen carriage 125 after having been rotated approximately 90 degrees, as tape 155 is fed upward by power rollers 159 and 161. Platen carriage 125 is rotated in the same angular direction that terminal end 171 of tape 155 is moved around platen 115 in moving from the tape over position shown in FIG. 12 to the position shown in FIG. 13. Platen carriage 125 is rotated by a stepper motor which rotates rotator bar 147, to which platen carriage 125 is mounted. Rotating platen carriage 125 approximately 90 degrees, in a clockwise direction as viewed in FIG. 13, wraps inward length 205 of strapping tape 155 around a second end 204 of documents 121, opposite of first end 202, disposing inward length 205 aside of and adjacent to terminal end 171. Since inward length 205 is adjacent to the portion of tape 155 extending from terminal end 171, it may be pushed from the position shown in FIG. 15 to a position flush against terminal end 171 shown in FIG. 16.

FIG. 16 depicts strapping unit 53 after rack 175 has been extended to press weld head 173 against documents 121. Drive gear 177 is operated by a stepper motor to rotate and extend rack 175 outward and above the cover plate 153. Prior to engaging documents 121, weld head 173 will have member 187 spaced apart from member 189, as shown in FIG. 9. Once member 187 of weld head 173 is pressed against documents 121, member 187 will be pushed flush against member 189 and cause tab 193 to extend between infrared sensor 195. At this point, the stepper motor drive gear 177 will stop. It should also be noted that the controller unit controlling operation of currency document processor 11 will compare the number of steps actually operated to the number of steps expected for moving member 187 of weld head 173 to engage documents 121. Any discrepancies will cause an error alarm to be initiated and operation of currency processor 11 to be suspended.

Once the infrared sensor 195 indicates that member 187 is pressing against documents 121, power roller 159 and 161 will operate to tension tape 155. After tape 155 is tensioned, weld head 173 will be pushed, or jammed, up against documents 121 with five (5) to seven pounds (7) of force to insure that documents 121 are compacted. Then, a long burst of electric current will be passed through weld coil 183 of weld head 173 to fuse inward length 205 of tape 155 to a portion of tape 155 extending from terminal end 171, the terminal end portion. Tape 155 is preferably formed of a thermoplastic which may be combined with paper, fibers or other components. The thermoplastic of tape 155 will soften when heated and fuse with adjacent tape so that inward length 205 will fuse to the portion of tape 155 extending from terminal end 171, and then will cool to bond end 171 to length 205. Then, a short cooling dwell time is provided to allow the tape 155 to cool after end 171 is fused to inward length 205.

Then, a short burst of current is passed through cutting wire 185 to cut inward length 205 so that tape 155 may be retracted by power rollers 159 and 161 to the tape home position adjacent to tape above deck sensor 169, as documents 121 remain bound together by the section of strapping tape extending from inward length 205 to terminal end 171. Then, a short burst of electric current is passed through weld coil 183 so that any portion of the thermoplastic material of tape 155 which is sticking to heating coil 183 will release. After the sort burst to free weld coil 183 from inward length 205, rack 175 is retracted back to the home position, flush with cover plate 153, by a stepper motor moving drive gear 177.

Figure 17:
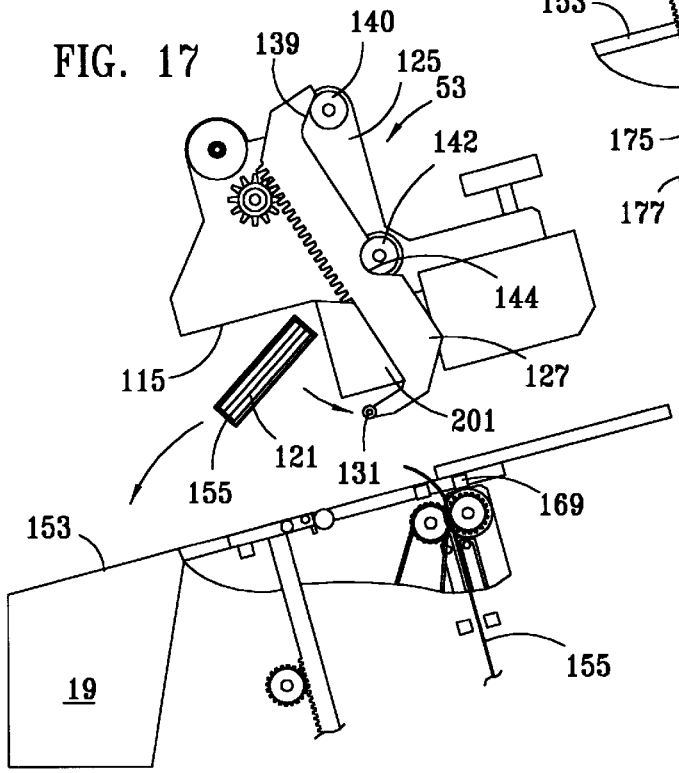

FIG. 17 depicts bound documents 121 being released from platen carriage 125 of the strapping unit 53. Racks 127 and 129 are extended so that retainer arm 131 is pulled outward from platen 115 and aside of turn around head 201. Cam surface 139 engages roller 140 and bearing surface 144 receives roller 142 so that rack 127 will move sufficiently upward to pull retainer arm 131 outward from between platen 115 and turn around head 201. Documents 121, which are bound by strapping tape 155, then fall from engaging platen 115 onto cover plate 153 and into discharge bin 19. Carriage 125 of strapping unit 53 is then rotated back to the home position, depicted in FIG. 12. The process steps depicted in FIGS. 12 through 17 are repeated to stack and then bind more documents into a document bundle.

Figure 18:
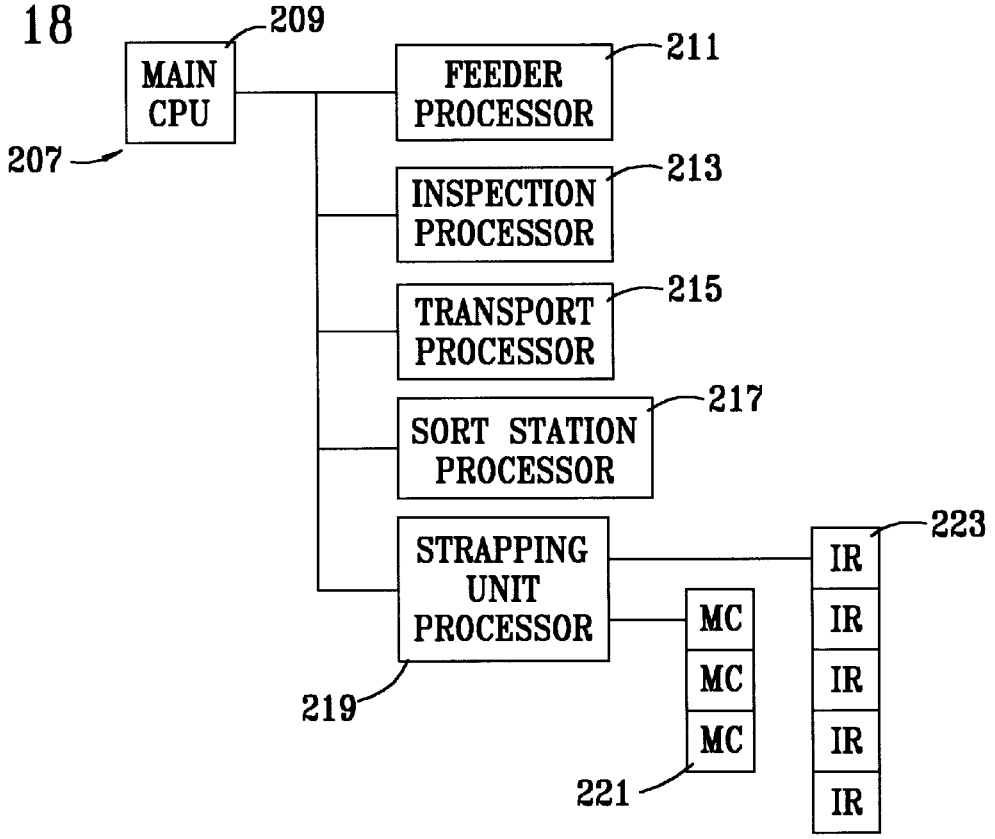
FIG. 18 is a block diagram which schematically illustrates a controller for use with the present invention.

FIG. 18 is a block diagram which schematically depicts controller 207 of currency document processing unit 11. Controller 207 includes main CPU 209, which interfaces with plurality of input/output controller processors 211, 213, 215, 217 and 219. Main CPU 209 interfaces with feeder processor 211, which controls operation of loose document feeder 21. Inspection processor 213 interfaces with main CPU 209 and controls operation of IR scanner 27, capacitance scanner 29 and IR reflectance scanner 31. Transport processor 215 controls operation of the synchronous main drive motor which powers the drive belts, such as transport belts 23, 25, 42 and 44. Sort station processor 217 controls operations of sort gate 39. Strapping processor 219 processes signals from infrared sensors 223 and controls operation of strapping unit 53 in response to data signals from infrared sensors 223 and main CPU 209. Other sort station processors and strapping unit processors would be required in addition to sort station processor 217 and strapping processor 219 for additional strapping units, such as strapping unit 51.

Figure 19A:
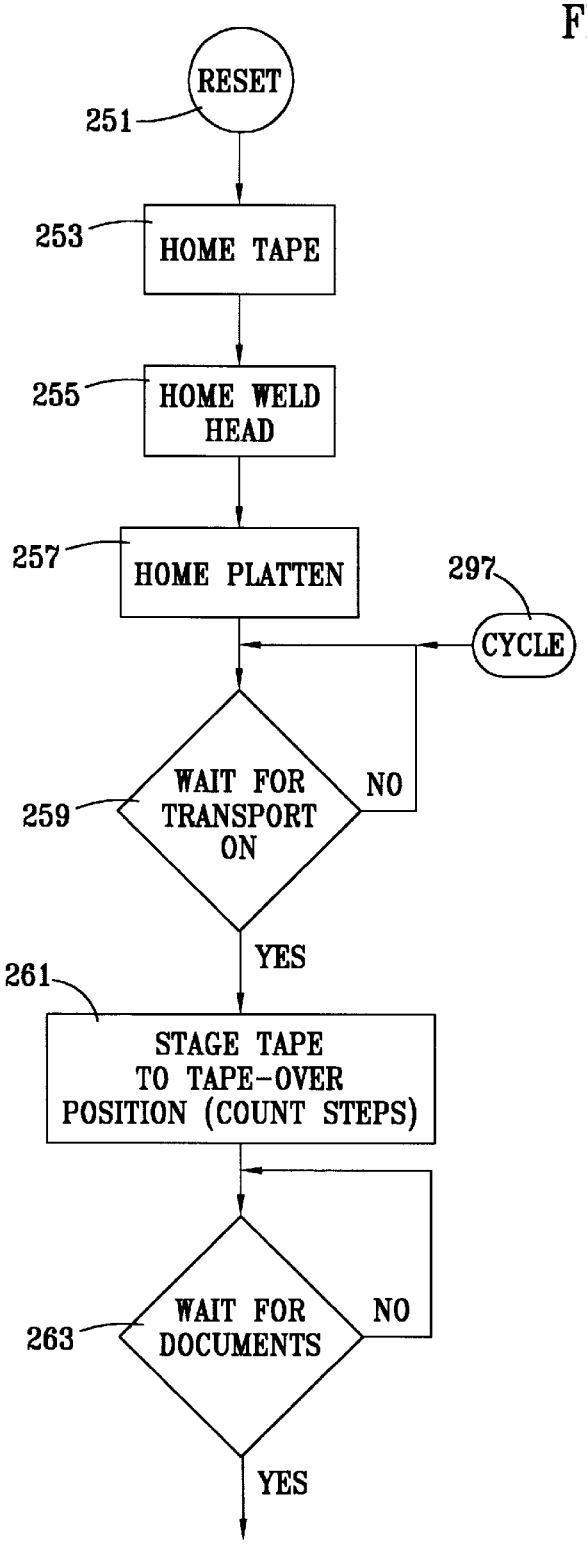
FIGS. 19*a*–19*c* together depict a flowchart of a method for binding a bundle of currency documents according to the present invention.
Figure 19B:
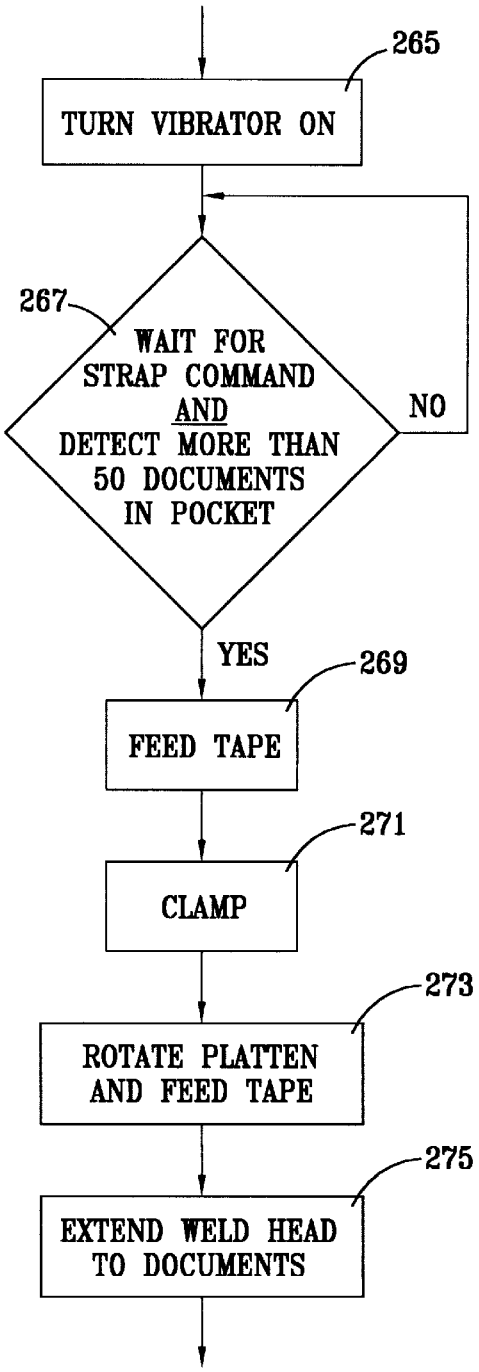
Figure 19C:
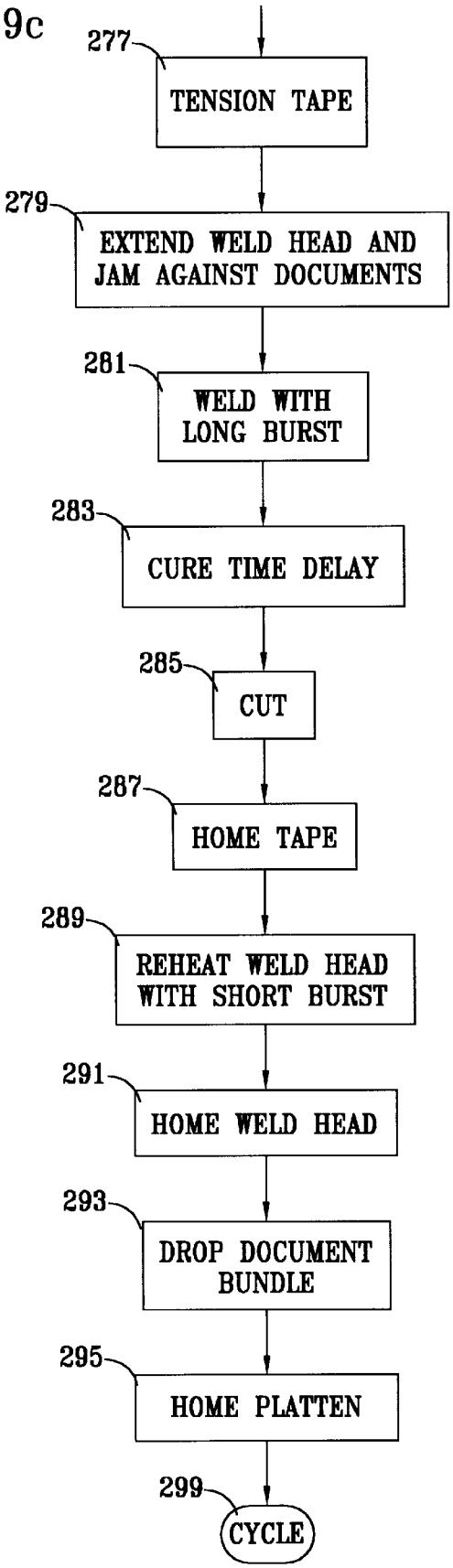

FIGS. 19*a*–19*c* illustrate a flowchart which depicts operation of strapping unit processor 219 for controlling operation of strapping unit 53. Initially, reset signal 251 is sent to strapping unit processor 219 from main CPU 209. Then, as depicted in step 253, the terminal end 171 of tape 155 is moved to the home position shown in FIG. 7. In step 255 the weld head 173 is moved home. In step 257 platen 115 is moved to the home position. If any of the terminal end 171 of tape 155, weld head 173 or platen 115 are not detected in their respective home positions, a stop and alarm signal is sent to suspend operation of processor 219. It should be noted that continuously throughout the process, the infrared home and various position sensors are sampled and compared with expected values. If the detected values are not as expected, the operation of unit 11 is suspended and an alarm signal is sent to main CPU 209. Additionally, the number of steps over which stepper motors are operated is counted and compared to expected values at which infrared position sensors change state, and if any unexpected values are encountered a stop/alarm signal is emitted to suspend operation of processor 219 until reset by an operator.

In step 259 strapping unit processor 219 waits for a "transport on" signal to be sent by main CPU 209. Once the transport on signal is detected in step 259, step 261 commences and terminal end 171 of strapping tape 155 is staged to the tape over position adjacent to IR sensor 137 mounted to platen 115, as is depicted in FIG. 12. The number of steps it takes to operate the stepper motor to move terminal end 171 of tape 155 to the tape over position is counted so that the height of the platen 115 above deck 111 can be determined. In step 263 processor 219 is waiting for documents. Once the leading edge of the first document is detected by infrared sensor 45, processor 219 will move to step 265 and turn vibrator 113 on to vibrate deck 111. Stacking wheel 49 will also start operating.

Documents will then be stacked against platen 115 and on deck 111 until a strap command is sent from the main CPU 209 to strapping unit processor 219. Once both the strap command is sent from main CPU 209 and reflective IR detector 123 detects that more than fifty (50) documents have been stacked against platen 115, then strapping will commence. If the strap command is received without more than fifty (50) documents being detected by IR sensor 123, currency document processing unit 11 will be stopped and an alarm signal will be sent to main CPU 209. More than fifty (50) documents may be strapped at one time. Sensor 123 provides feedback to assure that currency processing unit 11 is operating properly; it does not limit the maximum number of documents which may be stacked at one time on platen 115.

Once both the strap command is received and more than fifty (50) documents are detected by infrared sensor 123, tape 155 will be fed in step 269 to move terminal end 171 from the tape over position up to the top of channel 119 in platen 115, against the curved surface 203 of turn around head 201, and then down around the outward side 122 of documents 121 until terminal end 171 of tape 155 is approximately one-half (½) inch above deck 111, as shown in FIG. 13. This wraps tape 155 around three sides of the documents stacked on platen 115. In step 271 rack 127 is retracted to move retainer arm 131 against tape 155 and the outward side 122 of documents 121 to clamp tape 155 and documents 121 against platen 115, as shown in FIG. 14. Step 273 depicts rotating platen 115 and feeding tape 155 to provide slack in tape 155 as platen 115 is rotating, to move platen 115 from the position of FIG. 14 to the position of FIG. 15. This wraps strapping tape 155 around a fourth side of the documents stacked on platen 115.

In step 275, weld head 173 is extended to push inward length 205 of tape 155 adjacent to outward side 122 of documents 121. In step 277 tape 155 is tensioned and pulled tight around documents 121, while retainer arm 131 holds the portion of tape 155 adjacent to terminal end 171 in place against outward side 122. In step 279 weld head 173 is extended even further to jam against documents 121. In step 281 a long burst of electric current passes through weld coil 183 to fuse inward length 205 to the portion of tape 155 adjacent to terminal end 171. Then, the current is turned off and a cure time delay is provided in step 273 to allow the weld to cure. In step 285 current is passed through wire 185 to cut inward length 205 of tape 155. In step 287 tape 155 is moved back to the home position adjacent to infrared above deck sensor 169, as shown in FIG. 17.

In step 289 a short burst of electric current is passed through weld head coil 183 to free weld coil 183 from the portion of tape 155 which extends around documents 121. Then in step 291, weld head 173 is retracted and moved to the home position shown in FIG. 17. In step 293, rack 127 is extended to move retaining arm 131 away from bundled documents 121 and drop the bundle of documents 121 into bin 19, as depicted in FIG. 17. Then the platen is moved back to the home position in step 295 by rotating platen carriage 125 counterclockwise until tab 133 extends between infrared sensor 135, as depicted in FIG. 6. Once platen 115 is in the platen home position, in step 297 the cycle is repeated by going back to step 259 and waiting for the transport on signal to be sent from main CPU 209.

Figure 20:
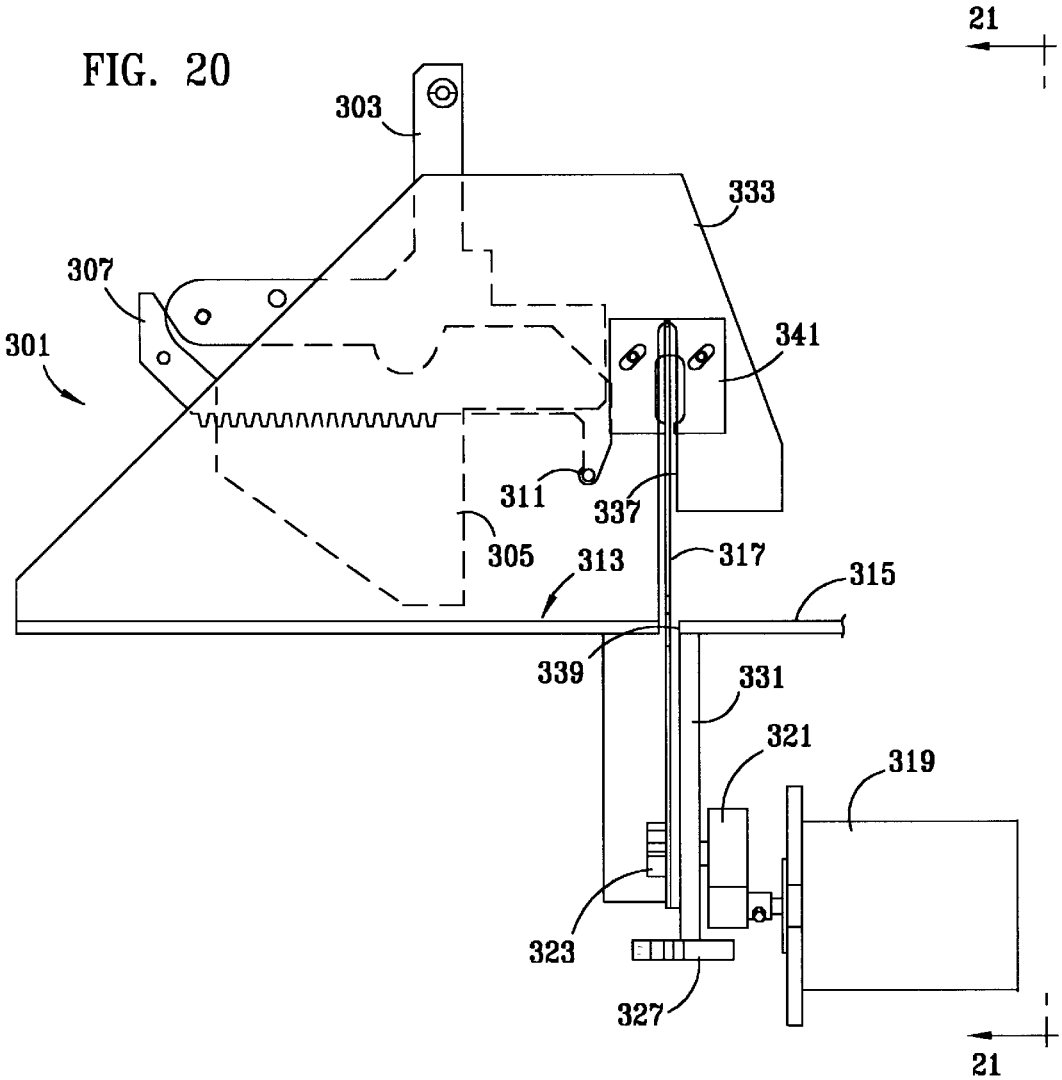
FIG. 20 is a side elevational view which schematically illustrates an alternative strapping unit having a buffer shelf for stacking and then staging currency documents.

FIG. 20 is a side elevational view of an alternative strapping unit 301. Alternative strapping unit 301 has a platen carriage 303, a platen 305, racks 307 (one shown), and a retaining bar 311, which are preferably the same as those described above for strapping unit 53. Stacking deck 313 is similar to stacking deck 111 of strapping unit 53, except that it has been extended 1¾ inches to provide buffer shelf 315. Buffer shelf 315 separates a stacker wheel from the platen 305 of strapping unit 301 by the additional 1¾ inches as compared to stacker unit 53. A staging blade 317 provides a retractable staging member having a face which is selectively movable into an extended position (shown in FIG. 20) for extending adjacent and transverse to the buffer shelf 315. Stepper motor 319 is provided for selectively moving staging blade 317.

Figure 21:
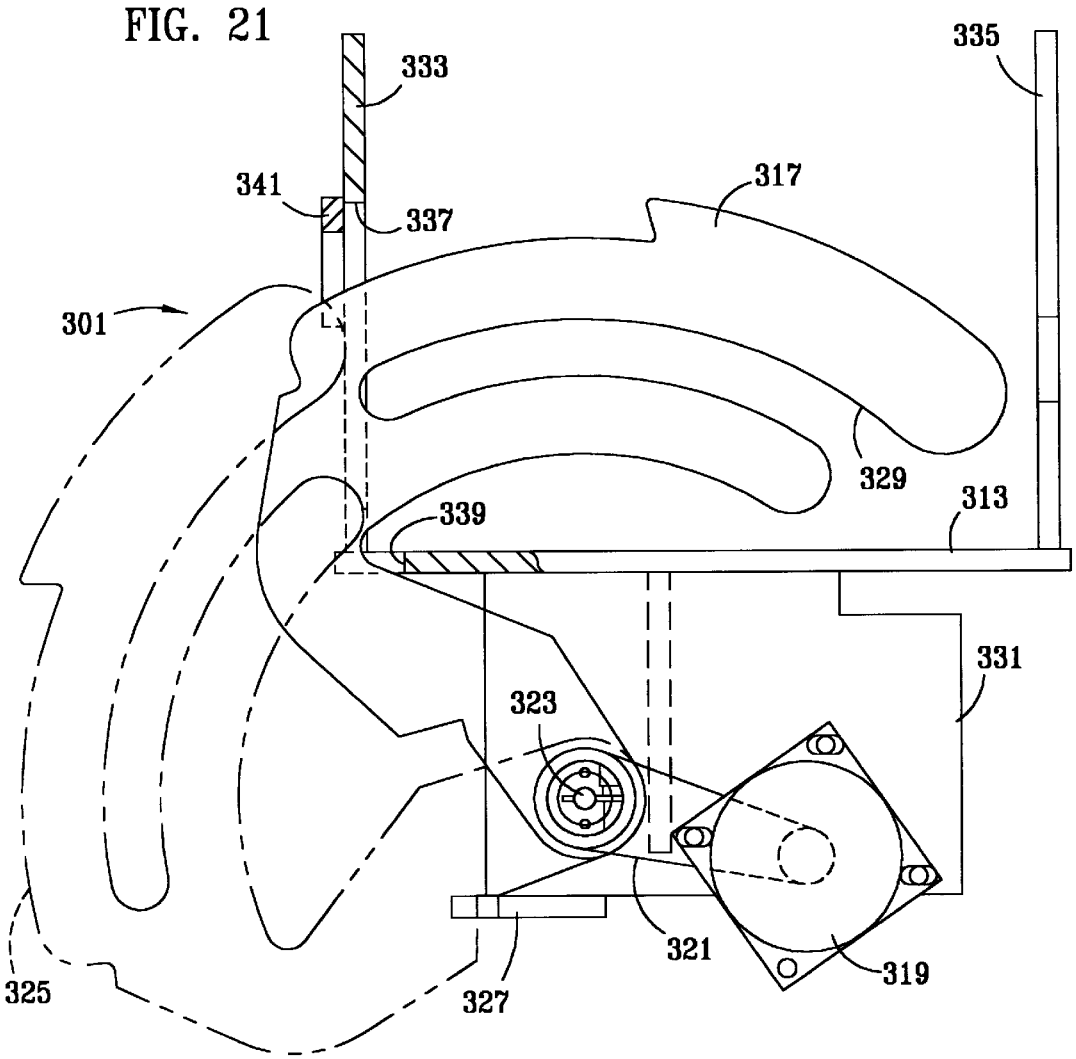
FIG. 21 is a partial cutaway, side elevational view of the strapping unit of FIG. 20, viewed along section line 21—21 of FIG. 20.

FIG. 21 is a side elevational view of alternative strapping unit 301, as viewed along section line 21-21 of FIG. 20. Toothed pulley belt 321 connects between toothed pulleys mounted a drive shaft of stepper motor 319 and a shaft to which staging blade 317 is ridigly secured. Stepper motor 319 powers a toothed pulley belt 321 to move blade 317 between the extended position, labeled 317, and the retracted position 325, which is shown in phantom. IR sensor 327 detects when staging blade 317 is in the retracted position, removed from above buffer shelf 315. The retracted position 325 is a home position for blade 317. A slot 329 is cut into staging blade 317 to reduce its mass. Preferably, staging blade 317 is formed from a light weight material, such as 0.060 inch thick aluminum plate, to have a small mass. Stepper motor 319 is preferably selected for moving staging blade 317 between the extended and retracted positions within 50 milliseconds.

Referring to FIGS. 20 and 21, bracket 331 is provided for mounting bearing 323 and motor 319 beneath buffer shelf 315. Bearing 323 rotatably secures to bracket 331 the shaft to which staging blade 319 is fixedly, or rigidly, secured. Guide plates 333 and 335 extend upwards from buffer shelf 315 of stacking deck 313. Slot 337 extends into guide plate 333 for passing staging blade 317. Slot 339 is formed into one side of stacking deck 313 for allowing staging blade 317 to pass between the extended and retracted positions. Blade guide 341 is mounted to guide plate 333 for directing staging blade 317 as it is moved between the extended and retracted positions.

Figure 22:
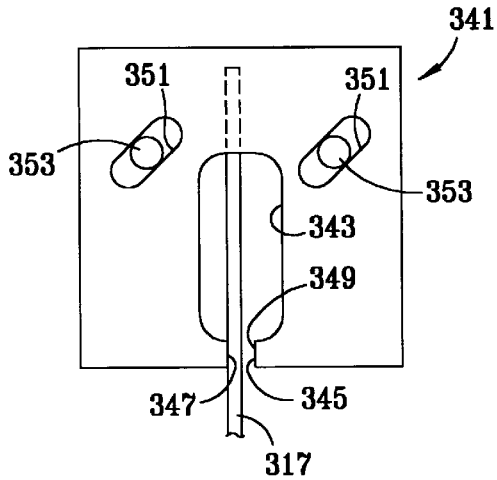
FIG. 22 is an enlarged side elevational view depicting a guide member of the alternative strapping unit of FIG. 20 in more detail.

Referring to FIG. 22, a detailed view illustrates blade guide 341 of FIG. 20 in more detail. Blade guide 341 is preferably made of delrin plastic. Blade guide 341 includes the guide slot 343, which narrows to a gap 345 which extends between mutually facing shoulders 347 and 349. The width of gap 345 is selected so that shoulder 347 will continuously press against one side of blade 317, without the other shoulder 349 binding upon blade 317 as blade 317 is moved between the extended and retracted positions. At least one of shoulders 347 and 349 should continuously be in contact with blade 317 the entire time that blade 317 is moving. Slots 351 are provided for selectively adjusting the positioning of gap 345 of blade guide 341 so that shoulder 347 will press against one side of blade 317. Fasteners 353 are used within slots 351 secure blade gap 341 in position on guide plate 333.

In operation, when a first stack of currency documents are being bound with strapping tape within the alternative strapping unit 301 according to the process described above for strapping unit 53, staging blade 317 will be moved from the retracted position 325 to the extended position 317 depicted in FIG. 21. A stacker will continuously operate stacking currency documents on edge atop buffer shelf 315, with the sides of the currency documents resting against the face of staging blade 317. Once a preselected number, such as 100 currency documents, are accumulated in a second stack of documents disposed adjacent to staging blade 307 and atop buffer shelf 315, staging blade 317 will be moved to the retracted position 325 and the second stack of currency documents will then move downward atop stacking deck 313 to rest against platen 305. The strapping operation for binding the first set of documents with the strapping tape will preferably be completed prior to accumulation atop buffer shelf 315 of a second set of currency documents of the preselected number.

The strapping operation will then commence as described above for strapping unit 53, with the tape 155 being dispensed around the second set of currency documents and the retaining bar 311 being moved to the retracted position to hold the second set of currency documents and the tape against platen 305. After the currency documents pass from buffer shelf 315 across stacking deck 313 to rest against platen 305, staging blade 317 will then be moved from the retracted position 325 to the extended position 317 shown in FIG. 21. Currency documents will then be stacked upon buffer shelf 315 and against staging blade 317 as the previous set of documents are bound with the strapping tape.

The present invention provides several advantages over prior art currency document processing equipment. A lever arm connected to a potentiometer for controlling a feeder arm which feeds loose documents into the currency processing unit of the present invention. A nonsynchronous, vacuum feed belt is used for moving the loose documents from the stack of documents being moved by the feeder arm. The vacuum feed belt moves the documents past a separator head and into transport belts. One document at a time is fed into the transport belts. The currency documents are inspected for wear, sorted according to denomination, counted and stacked upon a platen. A strapping tape is dispensed by being bent to curve in a direction which is transverse to the length of the strapping tape, and then being pushed above the location at which the strapping tape is bent in the transverse direction. The strapping tape is pushed upwards and into interconnected strapping tape channels so that it is fed around at least part of the documents. The strapping tape is completely looped around the documents by passing a terminal end section of the strapping tape through the interconnected strapping tape channels, gripping the terminal end section with a retainer bar, and then rotating the platen with the strapping tape and documents being held in place against the platen. A printer is provided for printing onto the strapping tape so that different labels may be applied to the document of bundles strapped according to the present invention.

Although the preferred embodiment has been described in detail, it should be understood that various changes, substitutions and alterations can be made therein without departing from the spirit and scope of the invention as defined by the appended claims.

What is claimed is:

1. An apparatus for binding documents with a strapping tape to form a document bundle, the apparatus comprising in combination:

a platen having a support surface for receiving a stack of documents, and being movable from a first position to a second position;

a strapping tape dispenser disposed adjacent to the platen, with the strapping tape dispenser aligned for dispensing the strapping tape toward the platen and adjacent to the documents stacked on the support surface of the platen;

strapping tape guide means for receiving the strapping tape from the strapping tape dispenser and guiding the strapping tape to wrap around at least two sides of the stack of the documents;

retaining means for securing the strapping tape and the documents to the platen;

drive means for moving the platen from the first position to the second position, in which an outward end portion of the strapping tape is aligned with an inward length of the strapping tape with the strapping tape wrapped around the documents;

fastening means for securing the inward length of the strapping tape to the outward end portion of the strapping tape to bind the documents into a document bundle; and cutting means for cutting the strapping tape between the document bundle and the strapping tape dispensing means.

2. The apparatus according to claim 1, wherein:

the strapping tape is passed adjacent to three sides of the documents by the strapping tape guide means guiding the strapping tape to wrap around the stack of the documents; and the strapping tape is passed around a fourth side of the documents when the platen moves from the first position to the second position.

3. The apparatus according to claim 2, wherein the platen in moving from the first position to the second position rotates around a stationary axis.

4. The apparatus according to claim 1, wherein the strapping tape dispenser comprises a roller assembly for bending the strapping tape in a direction which is substantially transverse to a longitudinal length of the strapping tape.

5. An apparatus for binding documents with a strapping tape to form a document bundle, the apparatus comprising in combination:

a platen having a support surface for receiving a stack of documents, and being rotatably mounted for rotating about an axis;

a strapping tape dispenser disposed adjacent to the platen, with the strapping tape dispenser aligned for dispensing the strapping tape toward the platen and adjacent to the documents stacked on the support surface of the platen;

strapping tape guide means for receiving the strapping tape from the strapping tape dispenser and guiding the strapping tape to wrap around three sides of the stack of the documents;

retaining means for securing the strapping tape and the documents to the platen;

rotary drive means for rotating the platen about the axis to align an outward end portion of the strapping tape adjacent to an inward length of the strapping tape, with the strapping tape wrapped around the documents;

wherein rotating the platen wraps the strapping tape around a fourth side of the stack of documents, aligning the inward length adjacent to the outward end portion of the strapping tape;

fastening means for securing the inward length of the strapping tape to the outward end portion of the strapping tape to bind the documents into a document bundle; and cutting means for cutting the strapping tape between the document bundle and the strapping tape dispensing means.

6. The apparatus according claim 5, wherein the strapping tape guide means comprises:

a strapping tape feed channel extending across the platen, adjacent to the inward side of the documents; and a turn-around head having a strapping tape turn-around channel extending from the strapping tape feed channel to an outward side of the documents, the strapping tape turn-around channel having an arcuate surface for receiving the strapping tape from the strapping tape feed channel of the platen and directing the strapping tape around the first end of the document bundle and along the outward side of the documents.

7. The apparatus according to claim 6, wherein the strapping tape dispenser comprises a roller assembly for bending the strapping tape in a direction which is substantially transverse to a longitudinal length of the strapping tape.

8. The apparatus according to claim 5, wherein the axis is stationary, remaining in a fixed location as the platen is rotating.

9. The apparatus according to claim 5, wherein the strapping tape dispenser is stationary and the platen rotates relative to the strapping tape dispenser.

10. The apparatus according to claim 5, wherein the retaining means comprises a single retaining arm which secures both the strapping tape and the documents to the platen, pushing the strapping tape against the documents.

11. The apparatus according to claim 5, wherein the fastening means comprises:

a weld head for engaging the inward length of the strapping tape and pressing against the inward length, the outward end portion of the strapping tape and the outward side of the documents; and heating member for heating the inward length of the strapping tape to fuse the inward length to the outward portion of the strapping tape.

12. The apparatus according to claim 5, wherein the cutting means comprises:

a resistive wire through which electric current is selectively passed to heat the resistive wire; and means for pressing the resistive wire against the strapping tape between the document bundle and the strapping tape dispensing means.

13. The apparatus according to claim 5, further comprising:

a feed bin for loading loose documents;

feeder means for dispensing the documents from the feed bin, one at a time;

transport means for receiving the documents from the feeder means and transporting the documents toward the platen;

inspection means for inspecting the condition of the documents being transported by the transport means;

position detection means for detecting the presence of the documents being transported by the transport means;

document type detection means for detecting the document type of the documents being transported by the transport means;

sorting means for sorting the documents according to the document type;

stacker means for receiving the documents from the conveyor means and stacking the documents upon the platen, one of the documents at a time; and counting means for counting the number of the documents being stacked upon the platen.

14. A method for binding a plurality of documents into a document bundle with a strapping tape, the method comprising the steps of:

providing a platen which is movable between first and second positions, a strapping tape dispenser, a strapping tape feed chute, a pusher arm and a fastening head;

placing a stack of the documents onto the platen, with an inward side of the documents facing the platen and an outward side the documents facing away from the platen;

dispensing the strapping tape from the strapping tape dispenser and through the strapping tape feed chute to pass the strapping tape aside of the inward side of the documents, around a first edge of the documents, and then aside of the outward side of the documents;

securing the documents against the platen and the strapping tape to the platen;

moving the platen from the first position to the second position, disposing an inward length of the strapping tape aside of a second end of the documents, which is disposed opposite from the first end of the documents;

pressing the fastening head against the inward length of the strapping tape, and securing the inward length of the strapping tape to an outward end portion of the strapping tape to bind the documents into a document bundle, with the strapping tape between the inward length and the outward end portion being in tension;

cutting the strapping tape between the strapping tape dispenser and the inward length of the strapping tape;

releasing the document bundle from the platen; and moving the platen from the second position back into the first position.

15. The method according to claim 14, wherein the step of moving the platen from the first position to the second position comprises:

rotating the platen about an axis which extends transverse to a longitudinal length of the strapping tape and which extends parallel to the inward side of the documents.

16. The method according to claim 14, wherein the step of securing documents against the platen and the strapping tape to the platen comprise a single step of pressing a single retainer member against both the strapping tape and the documents.

17. The method according to claim 14, wherein the documents are stacked on the platen, one of the documents at a time.

18. The method according to claim 14, wherein the step of dispensing the strapping tape comprises the steps of:

bending the strapping tape to bend in a direction which is transverse to the longitudinal length of the strapping tape; and pushing the strapping tape from the strapping tape dispenser to the strapping tape feed chute.

19. The method according to claim 14, wherein the step of pressing the fastening head against the inward length of strapping tape comprises:

providing an extensible member disposed for pushing the fastening head against the inward length of the strapping tape;

mounting the fastening head to the extensible member; and extending the extensible member to press the fastening head against the inward length of strapping tape when the platen is disposed in the second position.

20. The method according to claim 14, wherein the step of pressing the fastening head against the inward length of strapping tape comprises:

providing an arm which is selectively extendable for moving the fastening head toward the inward length of strapping tape when the platen is disposed in the second position;

mounting the fastening head to the arm;

extending an arm to press the inward length of the strapping tape against the outward end portion of the strapping tape;

tensioning the inward length of the strapping tape with the strapping tape dispenser; and heating the inward length of the strapping tape to weld the inward length to the outward end portion of the strapping tape.

21. A method for binding a plurality of documents into a document bundle with a strapping tape, the method comprising the steps of:

providing a platen which is rotatable about a central axis, a strapping tape dispenser and a fastening head;

placing a stack of the documents onto the platen;

securing the stack of the documents to the platen;

dispensing the strapping tape from the strapping tape dispenser, while guiding a terminal end of the strapping tape around at least two sides of the documents and to a first position located adjacent to the platen, with the length of the strapping tape extending transverse to the central axis;

securing the strapping tape to the platen;

rotating the platen around the central axis, wrapping the strapping tape around the stack of the documents disposed on the platen, with an inward length of the strapping tape extending adjacent to an outward end portion of the strapping tape;

tensioning the strapping tape between the inward length and the outward end portion of the strapping tape;

pressing the inward length of the strapping tape against a fastening head and securing the strapping tape inward length to the outward end portion of the strapping tape to bind the stack of documents into a document bundle with the strapping tape looped around the documents;

cutting the strapping tape between the powered strapping tape dispenser and the inward length of the strapping tape;

releasing the document bundle from the platen; and rotating the platen back to an initial position for placing a second stack of the documents onto the platen.

22. The method according to claim 21, wherein:

the step of dispensing the strapping tape from the strapping tape dispenser comprises passing the strapping tape around three sides of the stack of the documents to partially wrap the strapping tape around the documents; and the step of rotating the platen comprises rotating the platen for an angular displacement of approximately 90 degrees to wrap the strapping tape around a fourth side of the stack of the documents, to loop the strapping tape fully around the documents.

23. The method according to claim 21, wherein the step of tensioning the strapping tape comprises retracting an inwardly disposed portion of the strapping tape back into the strapping tape dispenser.

24. The method according to claim 21, wherein the step of securing the documents to the platen comprises lowering an arm against the outward end portion of the strapping tape and pressing the outward end portion against the outward side of the documents, pressing the stack of the documents against the platen.

25. The method according to claim 21, wherein the outward end portion of the strapping tape is welded to the inward length of the strapping tape by applying heat to the inward length of the strapping tape.

26. The method according to claim 21, wherein the documents are sorted according to type and then documents of a selected type are individually stacked on the platen.

27. The method according to claim 21, wherein the step of cutting the inward length of the strapping tape comprises:

providing a resistance cutting wire on the weld head;

pressing the resistance cutting wire against the inward length of the strapping tape, inward of the outward end portion of the strapping tape; and then, passing electric current through the resistance cutting wire to cut the strapping tape.

28. The method according to claim 21, further comprising the steps of:

providing a print head disposed adjacent to the strapping tape dispenser;

passing the strapping tape across the print head when dispensing the strapping tape; and printing a label upon the strapping tape with the print head.

* * * * *